United States Patent [19]

Schindehütte

[11] Patent Number: 4,644,692

[45] Date of Patent: Feb. 24, 1987

[54] DRIVE ASSEMBLY FOR THE WING OF A SWING-OUT SLIDING DOOR

[75] Inventor: Manfred Schindehütte, Calden, Fed. Rep. of Germany

[73] Assignee: Gebr. Bode & Co. GmbH, Kassel, Fed. Rep. of Germany

[21] Appl. No.: 735,624

[22] Filed: May 20, 1985

[30] Foreign Application Priority Data

May 24, 1984 [DE] Fed. Rep. of Germany ..... 3419338

[51] Int. Cl.[4] ..... E05D 15/10

[52] U.S. Cl. ..... 49/213; 49/225; 49/360

[58] Field of Search ..... 49/360, 213, 215, 130, 49/214, 225

[56] References Cited

U.S. PATENT DOCUMENTS

| | | | |
|---|---|---|---|
| 4,296,570 | 10/1981 | Balbach et al. | 49/360 |
| 4,337,596 | 7/1982 | Kern et al. | 49/215 X |
| 4,452,014 | 6/1984 | Markus | 49/360 |
| 4,457,108 | 7/1984 | Kuschel et al. | 49/213 |
| 4,503,638 | 3/1985 | Schindehutte | 49/213 |

*Primary Examiner*—Philip C. Kannan

*Attorney, Agent, or Firm*—Collard, Roe & Galgano

[57] ABSTRACT

Driving device for the wing of a swing-out type sliding door, in particular, a swing-out type outer sliding door for vehicles, including two or more spaced apart reversing rollers, one of which is located adjacent to the doorway. A belt is guided around the rollers and is pivotably attached to the wing of the door. The belt is reversibly driven, exerting a force on the wing coincident to its direction of movement.

5 Claims, 7 Drawing Figures

DRIVE ASSEMBLY FOR THE WING OF A SWING-OUT SLIDING DOOR

BACKGROUND OF THE INVENTION

The present invention relates to a drive assembly for the wing of a swing-out type sliding door. More particularly, it relates to such a drive assembly especially intended for a swing-out type outer sliding door for vehicles.

In conventional swing-out type sliding doors, a roller carriage is mounted in an articulated manner approximately in the center of the vertical edge of the wing of the door. The roller carriage runs on a guiding rail mounted on the outer side of the body of the vehicle during opening and closing of the door. In addition, in most cases, the wing of the door has additional top or bottom guiding means permitting the wing to be safely guided into the doorway. Such swing-out type sliding doors are driven with the help of a piston-and-cylinder type or an electrical drive, which, in turn cooperate with a rack-and-pinion drive. However, with drives of this type, the problem exists that in the final phase of the sliding motion, resistances have to be overcome in the closing direction, the resistances being caused by the sealing of the door. This means that the wing of the door may have to be pushed into the doorway with a certain minimum speed, so that due to its force from inertia, it is capable of overcoming the resistance offered by the sealing of the door. Otherwise, special door closing aids which pull the wing of the door into the doorway have to be provided. In any case, special measures are required in order to permit the door to be properly closed.

This problem cannot be eliminated by boosting the piston-and-cylinder drive or rack-and-pinion drive because the force of the drive is substantially acting parallel to the plane of the door, whereas in the final phase of the door-closing operation, the wing of the door is substantially moving perpendicular to the plane of the door. This means that in the final phase of the closing action, the component of the driving force perpendicular to the plane of the door is close to zero.

Accordingly, it is an object of the invention to provide a drive assembly for the wing of a swing-out type sliding door, wherein the closing action can be properly executed without any special aids.

SUMMARY OF THE INVENTION

This and other related objects are attained according to the invention by the provision of a drive assembly for the wing of a swing-out sliding door driving the wing of the door by means of a belt guided around reversing rollers.

In a particularly advantageous embodiment of a drive of the aforementioned type, a guide element of a door wing is driven by means of such a belt guided around reversing rollers. The guide element may be a roller carriage mounted in an articulated manner on the wing of the door, whereby the roller carriage is guided by means of a guiding rail with a curved end section. The rail may be mounted on the outer side of the body of the vehicle, in which case the belt extends along the guiding rail.

In this embodiment, the one reversing roller has approximately the same radius of curvature as the curved end section of the guiding rail and the "one" reversing roller is supported approximately in the center of the curvature of the curved end section of the rail. This embodiment has the advantage that, even in the final phase of the closing action, the direction of the driving force coincides with the direction of movement of the wing of the door, so that the driving force is available in the full amount in order to overcome the resistances offered by the sealing of the door.

Most advantageously, in connection with the embodiment wherein the roller carriage is driven by means of a belt and the reversing roller has approximately the same radius of curvature as the curved end piece of the guiding rail, a pressure or push-and-pull absorbing connecting element is jointed on the one side with the belt and on the other side with the roller carriage, whereby this connecting element assumes a dead-point position when the wing of the door is in the closed position. This embodiment assures that due to the dead center position, the wing of the door is automatically kept closed in the closed position.

The belt may be driven by means of an electric motor; the belt may be a cogged belt or take the form of other conventional transporting means.

BRIEF DESCRIPTION OF THE DRAWINGS

Other objects and features of the present invention will become apparent from the following detailed description taken in connection with the accompanying drawings which disclose several embodiments of the invention. It is to be understood, however, that the drawings are designed for the purpose of illustration only and are not intended as a definition of the limits of the invention.

In the drawings.

DETAILED DESCRIPTION OF THE PREFERRED EMBODIMENTS

Figure 1:
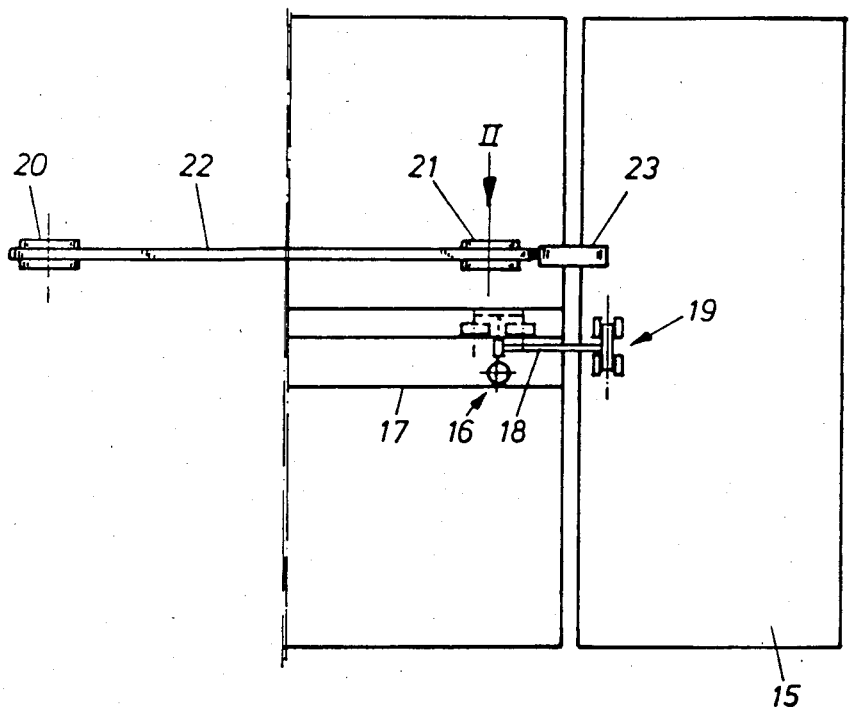
FIG. 1 is a front elevational view of the basic drive assembly embodying the present invention connected to a vehicle door.
Figure 2:
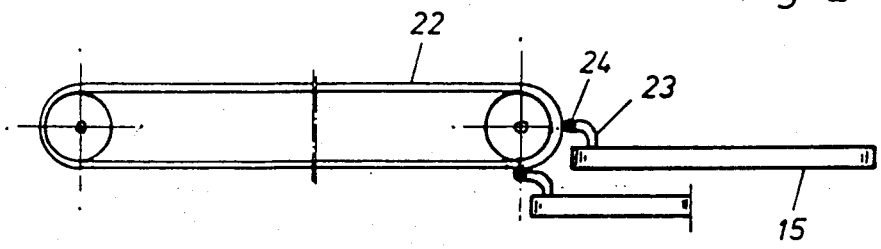
FIG. 2 is a plan view of the drive assembly shown in FIG. 1, but showing two successive positions of the vehicle door wing.

Referring now in detail to the drawings, and, in particular FIG. 1 thereof, therein illustrated is a drive assembly embodying the present invention connected to a swing-out type sliding door for a vehicle. The door has a wing 15 which is guided with the help of a roller carriage 16 running on an outer rail 17 affixed to the vehicle outer body. Roller carriage 16 is pivotally connected to the wing 15 of the door at point 19 with the help of an arm 18. This design for guiding the wing of a door is known per se. The drive assembly for the wing of the door is arranged above outer rail 17. The drive assembly consists of two rollers 20 and 21, around which a belt 22 is guided. Door wing 15 is pivotably connected to belt 22 by a connecting arm 23, which is rigidly arranged on the wing of the door, but pivotably connected to belt 22 at point 24 (FIG. 2).

This arrangement shows clearly that when belt 22 is driven, for example, by means of an electric motor, the door wing 15 may be pulled from the doorway, and, in the same way, pulled back into the doorway via belt 22 to effect opening and closing of the doorway with wing 15, respectively.

Figure 3:
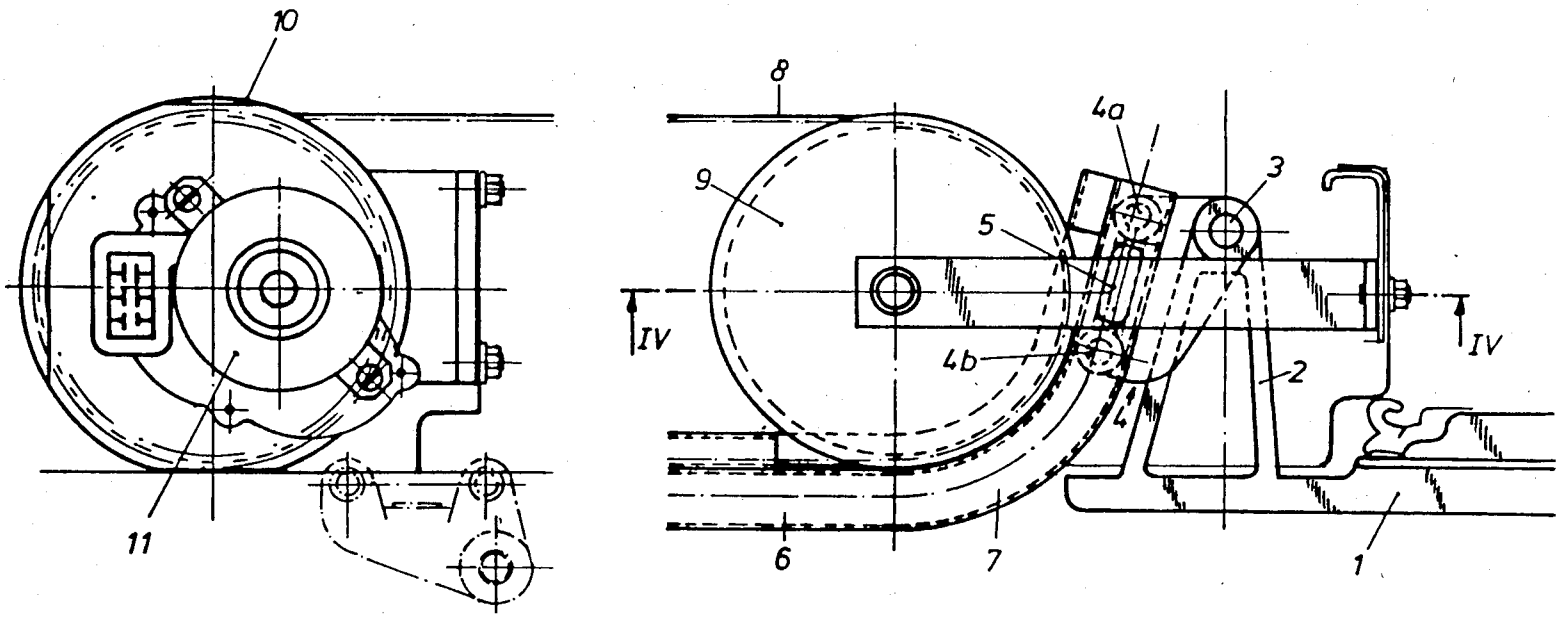
FIG. 3 is an enlarged, fragmentarily-illustrated top view of a second embodiment of the drive assembly showing a belt driving the roller carriage of the swing-out type sliding door, with a subsequent position of the roller carriage being shown in phantom line.

In FIG. 3 a second embodiment is illustrated wherein the wing of the door identified by reference numeral 1, has an inwardly directed support 2 for receiving a universal-joint-type axle 3, on which a roller carriage 4 is pivotably mounted. Roller carriage 4 has guide rollers 4*a* and 4*b* as well as a support roller 5. Rollers 4*a* and 4*b* and support roller 5 run in a guide rail 6 which is mOunted on the outer side Of the body of the vehicle, and has within the zone of the doorway an inwardly curved end piece 7. An endless belt 8 drives the wing 1 of the door, the belt being looped around the reversing roller 9 and extending along the guide rail 6. Furthermore, the endless belt 8 is guided around the roller 10, which is driven by means of a motor 11, e.g., an electric motor.

Figure 5:
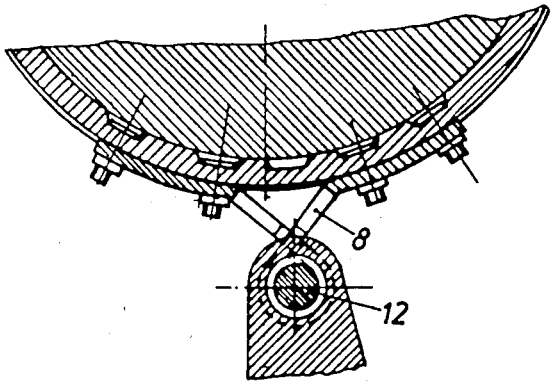
FIG. 5 is a fragmentarily-illustrated top sectional view of the connection of the belt to the roller carriage.

In this second embodiment, belt 8 is connected to the means for guiding the wing 1 of the door, i.e., roller carriage 4. As shown in greater detail in FIG. 5, belt 8 is looped around a driver 12 mounted on roller carriage 4.

Figure 4:
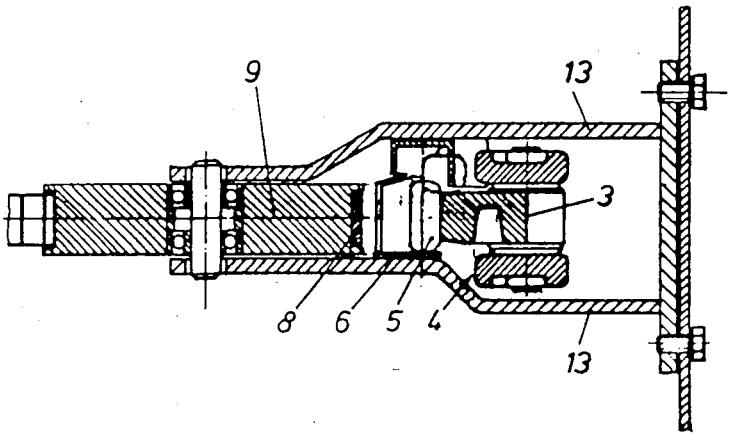
FIG. 4 is a sectional view taken along line IV—IV of FIG. 3.

FIG. 4 shows in greater detail roller 9 and belt 8 guided thereon, as well as guide rail 6 on which support roller 5 is resting. Universal-joint-type axle 3 supports roller carriage 4 as described earlier. The parts identified by reference numeral 13 are parts of the body of the vehicle.

In the embodiment as shown in FIG. 3, reversing roller 9 is supported approximately in the center of the curvature of curved end piece 7 of the guide rail. Reversing roller 9 has approximately the same radius of curvature as the curved end piece. This provides the advantage that even in the final phase of the closing movement, the direction of the driving force coincides with the direction of the motion of the wing of the door, so that the full driving force is available for overcoming the resistance offered by the sealing of the door.

Figure 6:
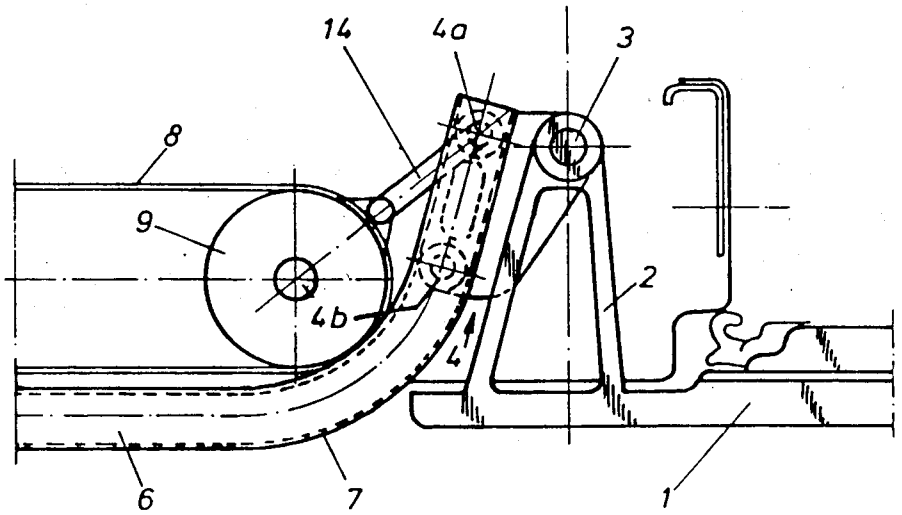
FIG. 6 is a fragmentarily-illustrated top view of a third embodiment of the invention wherein the wing of the door is automatically locked in the closed position.

FIG. 6 illustrates another embodiment, in which belt 8 is connected to roller carriage 4 by way of a tension-compression connecting element 14, e.g., a double-acting cylinder. The connecting element is pivotably secured both on the belt and the roller carriage and, in the closed position of the wing of the door, it assumes a dead-center position. When the connecting element is in the dead-center position, the forces applied to the belt by the roller carriage by means of the connecting element pass through the center point of the reversing roller 9. Therefore, the wing of the door cannot be opened because the roller carriage cannot be moved by pulling the wing 1 of the door by hand due to the fact that the one component of the force passes through the dead center. With such a design, it is possible to omit the lock for the door, which otherwise is required. The design may also be such that the connecting element assumes a position slightly beyond the dead-center position, i.e., a position in which the roller carriage has the tendency to run in the closing direction.

Figure 7:
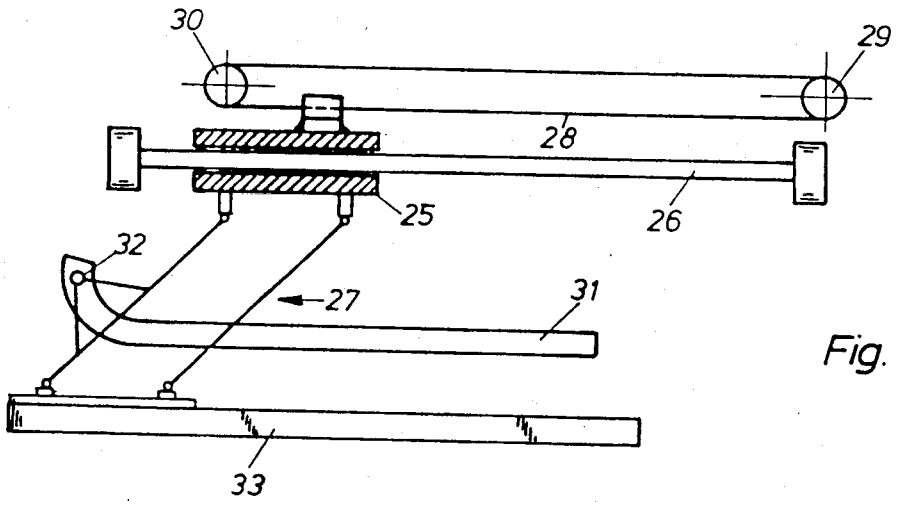
FIG. 7 is a partially schematic top view, in part section, of yet a fourth embodiment of the invention.

FIG. 7 shows yet another embodiment of the invention wherein movement of the wing 33 of the door is aided by guiding means in the form of a carriage 25 guided on a guide 26 having, for example, the form of a bar or rod. The wing 33 of the door is pivotably coupled to carriage 25 with the help of a steering parallelogram 27. The carriage 25 is rigidly connected with the belt 28, and belt 28 is guided around reversing rollers 29 and 30. In order to displace the wing of the door from the doorway, a correspondingly curved guide rail 31 and a roller 32 running in the rail, are provided, the roller 32 being connected to the wing 33 of the door. It is obvious that when belt 28 is driven, the wing 33 is first displaced from the doorway because it is forced to perform such a displacement by guide rail 31 and roller 32 guided therein. Once the wing 33 has been displaced generally laterally from the doorway, it is further displaced longitudinally therefrom via guide 26 and carriage 25, the latter of which is driven by belt 28.

Thus, while only several embodiments of the present invention has been shown and described, it will be obvious that many changes and modifications may be made thereunto, without departing from the spirit and scope of the invention.

What is claimed is:

1. A drive assembly for the wing of a swing-out type sliding door, wherein the wing slides into and out of a doorway, comprising:

at least two spaced-apart reversing rollers, one of which is positionable adjacent to the doorway:

a belt guided around said rollers;

a guide element for the wing of the door, including a guide rail having a curved end piece, said guide rail being positioned adjacent to said belt with said curved end piece thereof disposed adjacent to said one reversing roller, and a roller carriage mounted on said rail for movement therealong which is adapted for pivotable securement to the door wing; and means for coupling said belt to said carriage.

2. The drive assembly according to claim 1, additionally including means for reversibly driving said belt.

3. The drive assembly according to claim 1, wherein said curved end piece of said guide rail has approximately the same center of curvature and radius of curvature as said one reversing roller so that upon driving said belt, said belt exerts a driving force on the wing of the door coinciding with the direction of motion of the wing even in the final phase of the closing movement.

4. The drive assembly according to claim 1, wherein said means for coupling said belt to said guide element is a tension-compression-type connecting element pivotably linking said carriage to said belt so that, when the wing is in a closed position relative to the doorway, said connecting element assumes a dead center position, thereby tending to maintain the door in said closed position.

5. The drive assembly according to claim 1, wherein said means for connecting comprises a stationary guide rail positioned adjacent to and along said belt, a carriage slidably mounted on said guide rail and affixed to said belt, and parallelogram guide means pivotably connected to said carriage and adapted for pivotable securement to the door wing.

* * * * *